US008747142B2

(12) United States Patent
Zhang et al.

(10) Patent No.: US 8,747,142 B2
(45) Date of Patent: Jun. 10, 2014

(54) CONNECTOR ASSEMBLY

(75) Inventors: Sheng-Mei Zhang, Wuhan (CN); Li-Fu Xu, Wuhan (CN); Xin-Xiang Li, Wuhan (CN); Hui Yu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 11 days.

(21) Appl. No.: 13/525,606

(22) Filed: Jun. 18, 2012

(65) Prior Publication Data

US 2013/0084732 A1 Apr. 4, 2013

(30) Foreign Application Priority Data

Sep. 30, 2011 (CN) ..... 2011 1 0297227

(51) Int. Cl.
*H01R 13/627* (2006.01)

(52) U.S. Cl.
USPC ..... 439/354

(58) Field of Classification Search
USPC ..... 439/353, 354, 357, 358
See application file for complete search history.

(56) References Cited

U.S. PATENT DOCUMENTS

| | | | | |
|---|---|---|---|---|
| 2,891,103 | A * | 6/1959 | Swengel | 439/350 |
| 6,821,139 | B1 * | 11/2004 | Wu | 439/352 |
| 7,083,459 | B1 * | 8/2006 | Wu et al. | 439/354 |
| 7,160,137 | B1 * | 1/2007 | Yeh | 439/358 |
| 7,232,329 | B1 * | 6/2007 | Wu | 439/358 |
| 7,258,565 | B2 * | 8/2007 | Huang et al. | 439/353 |
| 7,410,365 | B2 * | 8/2008 | Wu | 439/76.1 |
| 7,892,014 | B2 * | 2/2011 | Amidon et al. | 439/353 |
| 8,033,853 | B2 * | 10/2011 | Chang | 439/304 |
| 8,287,299 | B2 * | 10/2012 | Ray et al. | 439/353 |
| 2005/0101176 | A1 * | 5/2005 | Kachlic | 439/352 |

* cited by examiner

*Primary Examiner* — Neil Abrams
(74) *Attorney, Agent, or Firm* — Novak Druce Connolly Bove + Quigg LLP

(57) ABSTRACT

A connector assembly includes a plug device and a socket device. The plug device includes a holding portion. The holding portion includes a top wall, a bottom wall opposite to the top wall, and an middle portion located between the top wall and the bottom wall. An inner surface of the top wall facing the middle portion defines a stopping hole. The socket device includes a main body and a resilient piece. The main body includes a top panel and a bottom panel opposite to the top panel. The resilient piece is located on the top panel. A latch portion is located on the resilient piece. The resilient piece is elastically deformable to engage the latch portion in the stopping hole. The main body is located between the top wall and the bottom wall. The middle portion is located on the top panel and the bottom panel.

20 Claims, 4 Drawing Sheets

CONNECTOR ASSEMBLY

BACKGROUND

1. Technical Field

The present disclosure relates to connector assemblies, and particularly to a connector assembly with an infallible mechanism.

2. Description of Related Art

A connector assembly is used for transmitting data between two electronic devices. The connector assembly includes a plug device and a socket device. The plug device is inserted into the socket device to electrically connect to the socket device. However, the plug device is easily disengaged from the socket device, because the plug device can not be firmly installed in the socket device.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
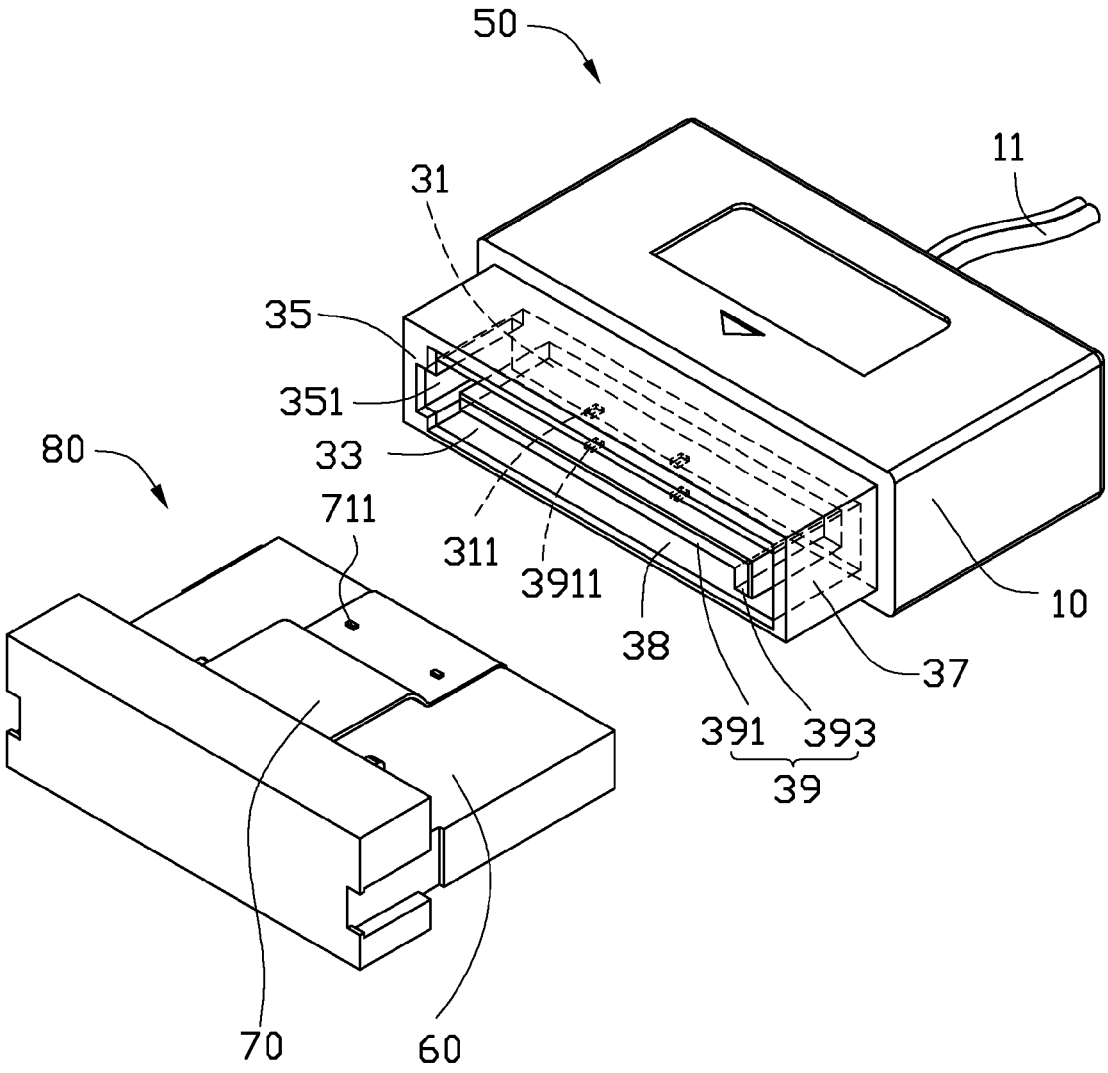
FIG. 1 is an exploded, isometric view of an embodiment of a connector assembly.

Referring to FIG. 1, a connector assembly of one embodiment includes a plug device 50 and a socket device 80.

The plug device 50 includes a connecting end 10 and a holding portion 30. A cable 11 is connected to the connecting end 10.

The holding portion 30 includes a top wall 31, a bottom wall 33, a first sidewall 35, a second sidewall 37, and a middle portion 39. The top wall 31, the bottom wall 33, the first sidewall 35, and the second sidewall 37 separately extend from the connecting end 10. In one embodiment, the first sidewall 35 is substantially parallel to the second sidewall 37 and perpendicularly connected to the top wall 31 and the bottom wall 33, and the top wall 31 is substantially parallel to the bottom wall 33. The top wall 31, the bottom wall 33, the first sidewall 35, and the second sidewall 37 cooperatively define a receiving space 38. The first sidewall 35 defines a positioning slot 351 communicating with the receiving space 38. An inner surface of the top wall 31 defines two stopping holes 311.

Figure 4:
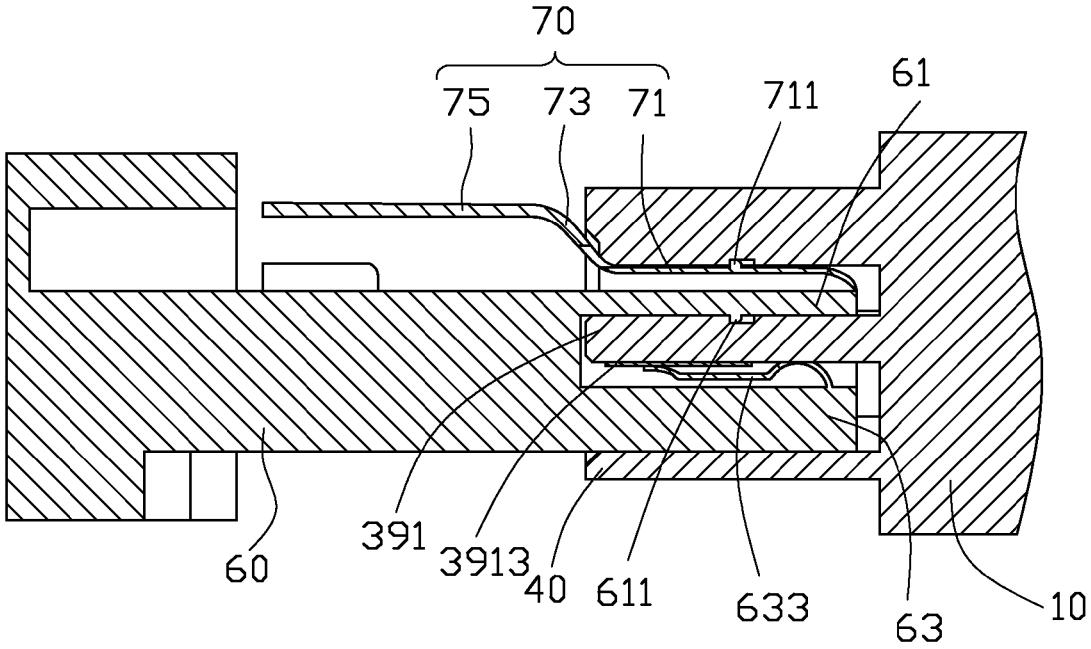
FIG. 4 is a cross-sectional view of the electronic device of FIG. 3, taken along the line IV-IV.

The middle portion 39 extends from the connecting end 10 and is placed in the receiving space 38. In one embodiment, the middle portion 39 is substantially L-shaped. The middle portion 39 includes an inserting board 391 and a positioning portion 393 located on one side of the inserting board 391. The inserting board 391 is located between the top wall 31 and the bottom wall 33. In one embodiment, the inserting board 291 is substantially parallel to the top wall 31 and the bottom wall 33. A first surface of the inserting board 391 facing the top wall 31 defines two latch holes 3911. A plurality of conductive pieces 3913 (shown in FIG. 4) is located on a second surface of the inserting board 391 facing the bottom wall 33.

Figure 2:
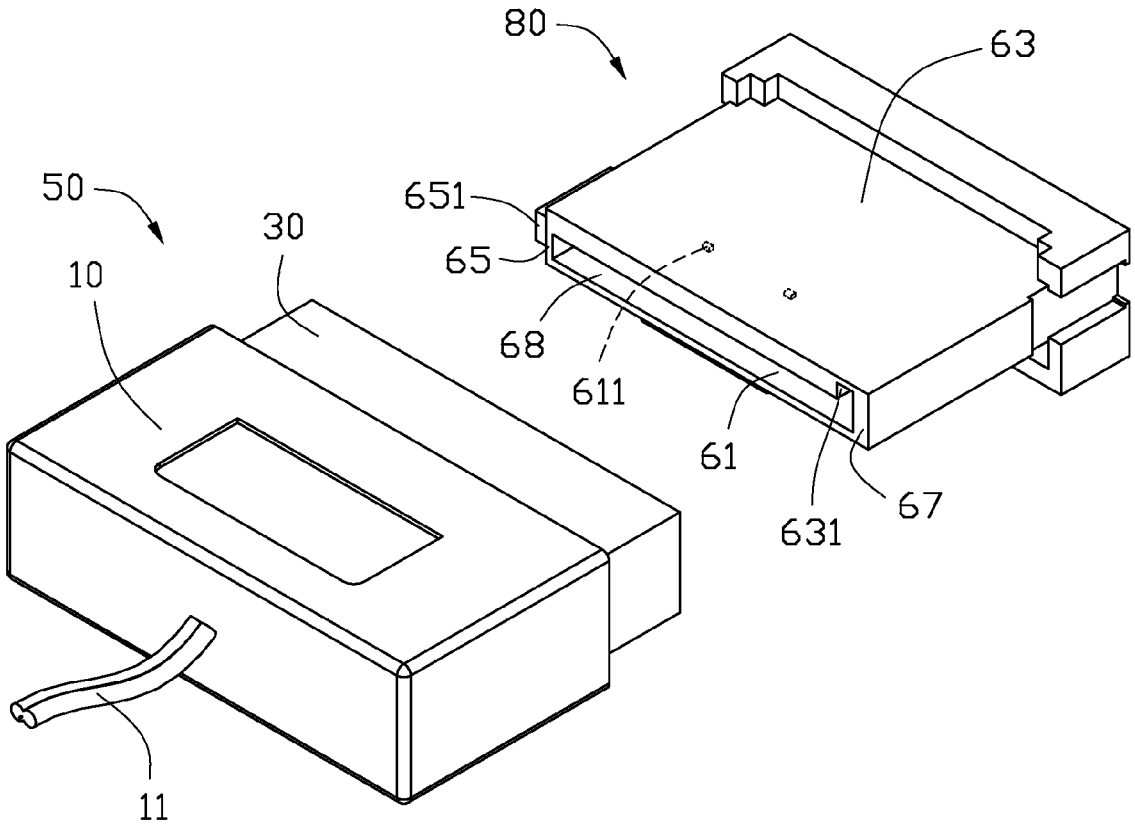
FIG. 2 is similar to FIG. 1, but viewed from a different aspect.

Referring to FIG. 2, the socket device 80 includes a main body 60 and a resilient piece 70. The main body 60 includes a top panel 61, a bottom panel 63, a first side panel 65, and a second side panel 67. In one embodiment, the first side panel 65 is substantially parallel to the second side panel 67 and perpendicularly connected to the top panel 61 and the bottom panel 63, and the top panel 61 is substantially parallel to the bottom panel 63. The top panel 61, the bottom panel 63, a first side panel 65, and the second side panel 67 cooperatively define a retaining space 68. The bottom panel 63 defines a limiting slot 631 communicating with the retaining space 68. A plurality of terminals 633 (shown in FIG. 4) is located on an inner surface of the bottom panel 63. A positioning piece 651 is located on an outer surface of the first side panel 65. Two protrusions 611 are located on an inner surface of the top panel 61. The resilient piece 70 is located on an outer surface of the top panel 61.

The resilient piece 70 includes a resilient portion 71, a connecting portion 73, and an operating portion 75. The resilient portion 71 and the operating portion 75 are located on two opposite sides of the connecting portion 73. A free end of the resilient portion 71 is connected to a front edge of the top panel 61. In one embodiment, a plane contains an outer surface of the top panel 61, and an acute angle is defined between the plane and the top panel 61. Two latch portions 711 protrude from the resilient portion 71. The connecting portion 73 extends from a distal end of the resilient portion 71. In one embodiment, a first obtuse angle is defined between the resilient portion 71 and the connecting portion 73. The operating portion 75 extends from a distal end of the connecting portion 73. In one embodiment, a second obtuse angle is defined between the connecting portion 73 and the operating portion 75.

Figure 3:
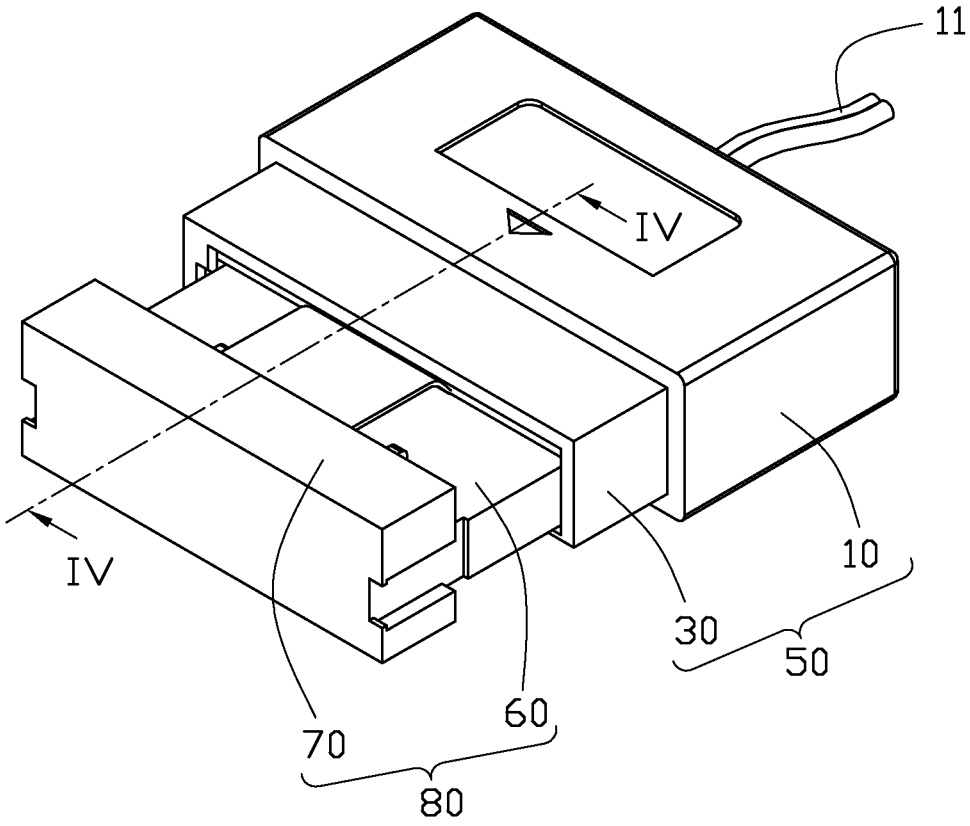
FIG. 3 is an assembled view of the connector assembly of FIG. 1.

Referring to FIG. 3, in assembly, the resilient portion 71 is elastically deformed by pressing the operating portion 75. The positioning piece 651 is aligned with the positioning slot 351. The socket device 80 is inserted into the receiving space 38 until the latch portions 711 are aligned with the stopping holes 311, and the protrusions 611 are aligned with the latch holes 3911. When the operating portion 75 is released, the resilient portion 71 elastically returns to engage the latch portions 711 in the stopping hole 311 and engages the two protrusions 811 in the latch holes 3911. The positioning piece 651 is received in the positioning slot 351, and the positioning portion 393 is received in the limiting slot 631. The top panel 61 abuts the inserting board 391 and is located between the inserting board 391 and the top wall 31. The bottom panel 63 abuts on the bottom wall 33 and located between the inserting board 391 and the bottom wall 33. The terminals 633 abut on the conductive pieces 3913 to electrically connect the connector assembly to the socket device 80.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. An apparatus comprising:

a plug device comprising:

a connecting end; and a holding portion; the holding portion comprising a top wall, a bottom wall opposite to the top wall, and a middle portion; the top wall, the bottom wall and middle portion extending from the connecting end, and the middle portion located between the top wall and the bottom wall and comprising an inserting board, a first surface of the inserting board facing the top wall defining a latch hole; an inner surface of top wall facing the middle portion defining a stopping hole, and the stopping hole and the latch hole being configured to secure the plug device to a socket device.

2. The apparatus of claim 1, wherein the inserting board is substantially parallel to the top wall and the bottom wall.

3. The apparatus of claim 2, wherein a plurality of conductive pieces are located on a second surface of the inserting board, the second surface is facing the bottom wall, and the plurality of conductive pieces are configured to electrically connect with the socket device.

4. The apparatus of claim 2, wherein the middle portion further comprises a limiting portion, and the limiting portion is perpendicularly connected to the inserting board.

5. The apparatus of claim 1, wherein the holding portion further comprises a first sidewall and a second sidewall, and the first sidewall and the second sidewall extends from the connecting end.

6. The apparatus of claim 5, wherein the first sidewall is substantially parallel to the second sidewall and perpendicularly connected to the top wall and the bottom wall.

7. The apparatus of claim 5, wherein the first sidewall, the second sidewall, the top wall and the bottom wall cooperatively define a receiving space, and the receiving space is adapted to receive the socket device.

8. The apparatus of claim 7, wherein the first sidewall defines a positioning slot communication with the receiving space.

9. An apparatus comprising:

a socket device comprising:

a main body, the main body comprising a top panel and a bottom panel opposite to the top panel, and a protrusion located on an inner surface of the top panel facing the bottom panel, and the protrusion being configured to engage with a plug device; and a resilient piece located on the top panel, a latch portion located on the resilient piece, and the latch portion configured to engage with the plug device by deforming the resilient piece.

10. The apparatus of claim 9, wherein a plurality of terminals are located on an inner surface of the bottom panel, the inner surface is facing the top panel, and the plurality of terminals are configured to electrically connect with the plug device.

11. The apparatus of claim 9, wherein the resilient piece comprises a resilient portion connected to the top panel, and an acute angle is defined between an outer surface of the top panel and the resilient portion.

12. The apparatus of claim 11, wherein the latch portion protrudes from the resilient portion.

13. The apparatus of claim 11, wherein the resilient piece further comprises a connecting portion extending from a distal end of the resilient portion, and a first obtuse angle is defined between the resilient portion and the connecting portion.

14. The apparatus of claim 13, wherein the resilient piece further comprising an operating portion, and a second obtuse angle is defined between the connecting portion and the operating portion.

15. The apparatus of claim 14, wherein the operating portion is substantially parallel to the resilient portion.

16. The apparatus of claim 9, wherein the main body further comprises a first side panel and a second side panel, the first side panel is substantially parallel to the second side panel and perpendicularly connected to the top panel and the bottom panel.

17. The apparatus of claim 16, wherein the top panel, the bottom panel, the first side panel and the second side panel cooperatively define a retaining space.

18. The apparatus of claim 17, wherein the bottom panel defines a limiting slot communication with the retaining space.

19. A connector assembly comprising:

a plug device, the plug device comprising a connecting end and a holding portion, the holding portion comprising a top wall, a bottom wall, and an middle portion; the top wall, the bottom wall and the middle portion extending from the connecting end, the middle portion located between the top wall and the bottom wall comprising an inserting board, a first surface of the inserting board facing the top wall defining a latch hole, an inner surface of the top wall facing the middle portion defining a stopping hole; and a socket device, the socket device comprising a main body and a resilient piece, the main body comprising a top panel and a bottom panel opposite to the top panel, and a protrusion located on an inner surface of the top panel facing the bottom panel, the resilient piece located on the top panel, a latch portion located on the resilient piece; wherein the resilient piece is elastically deformable to engage the latch portion in the stopping hole, the main body is located between the top wall and the bottom wall, and the middle portion is located on the top panel and the bottom panel, and the protrusion is engaged with the latch hole.

20. The connector assembly of claim 19, wherein a plurality of conductive pieces are located on a second surface of the inserting board, the second surface faces the bottom wall, a plurality of terminals are located on an inner surface of the bottom panel, the inner surface faces the top panel, and the plurality of terminals are configured to electrically connect with the plurality of conductive pieces.

* * * * *